US008565644B2

(12) United States Patent
Kawamichi

(10) Patent No.: US 8,565,644 B2
(45) Date of Patent: Oct. 22, 2013

(54) FIXING DEVICE AND IMAGE FORMING APPARATUS WITH FIXING DEVICE

(75) Inventor: Genichiro Kawamichi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 314 days.

(21) Appl. No.: 13/011,342

(22) Filed: Jan. 21, 2011

(65) Prior Publication Data

US 2011/0182620 A1 Jul. 28, 2011

(30) Foreign Application Priority Data

Jan. 27, 2010 (JP) ..... 2010-015767

(51) Int. Cl.
*G03G 15/20* (2006.01)

(52) U.S. Cl.
USPC ..... 399/122; 399/328

(58) Field of Classification Search
USPC ..... 399/122, 328, 330
See application file for complete search history.

(56) References Cited

U.S. PATENT DOCUMENTS

| | | | | |
|---|---|---|---|---|
| 5,201,852 | A * | 4/1993 | Ogoshi | 399/122 |
| 5,301,000 | A * | 4/1994 | Heigl | 399/122 |
| 6,002,908 | A * | 12/1999 | Hayashi et al. | 399/328 |
| 6,442,360 | B1 * | 8/2002 | Onodera et al. | 399/122 |
| 7,082,273 | B2 * | 7/2006 | Matsunai | 399/330 |
| 2008/0101826 | A1 | 5/2008 | Shiga et al. | |
| 2010/0172671 | A1 | 7/2010 | Onodera et al. | |
| 2011/0052258 | A1 * | 3/2011 | Kamoshida et al. | 399/122 |
| 2011/0194872 | A1 * | 8/2011 | Kikushima et al. | 399/122 |

FOREIGN PATENT DOCUMENTS

| | | |
|---|---|---|
| JP | 60-186467 | 12/1985 |
| JP | 2-130572 | 5/1990 |
| JP | 4-233570 | 8/1992 |
| JP | 5-504633 | 7/1993 |
| JP | 6-11984 | 1/1994 |
| JP | 7-504961 | 6/1995 |
| JP | 2001-143520 | 5/2001 |
| JP | 2002-23535 | 1/2002 |
| JP | 2002-278336 | 9/2002 |
| JP | 2008-134622 | 6/2008 |
| JP | 2010-181858 | 8/2010 |
| WO | WO 91/09351 | 6/1991 |
| WO | WO 93/19401 | 9/1993 |

OTHER PUBLICATIONS

Japanese Office Action dated Aug. 20, 2013 for Japanese Patent Application No. 2010-015767.

* cited by examiner

*Primary Examiner* — Susan Lee
(74) *Attorney, Agent, or Firm* — Oblon, Spivak, McClelland, Maier & Neustadt, L.L.P.

(57) ABSTRACT

A fixing device that allows simple and safe replacement of heating rollers. The fixing device includes a first lamp holder provided in the inner periphery of a retaining member, and an interlock device for locking and unlocking the first lamp holder and the retaining member. When replacing the heat roller, the interlock between the first lamp cartridge and the retaining member is unlocked to take out the retaining member and the heating roller from the opening of the frame of the image forming apparatus, while leaving the lamp cartridge inside the apparatus.

9 Claims, 16 Drawing Sheets

FIXING DEVICE AND IMAGE FORMING APPARATUS WITH FIXING DEVICE

TECHNICAL FIELD

The present invention generally relates to an image forming apparatus such as a laser beam printer, and more particularly, to a fuser roller replacement technique for image forming apparatuses.

BACKGROUND ART

A fixing device with a heating roller and a pressure roller is known as one used in image forming apparatuses such as laser beam printers or copying machines. This type of fixing device nips a sheet of recording medium bearing an unfixed toner image on it between the heating roller and the pressure roller, while it transports the recording medium, to apply heat and pressure to fix the toner image onto the recording medium.

Multiple heater lamps are placed as heat sources in the heating roller. In general, as the printing rate or the ream weight of paper supported by the image forming apparatus goes higher, the heat capacity required to fix the toner image increases. To maintain the temperature of the heating roller at or above a certain level, the fixing temperature goes higher and higher.

When the heating roller having been maintained at a high temperature comes to the end of its service life, it has to be replaced with a new one. In this case, operations of the image forming apparatus are stopped to cool down the heating roller to a temperature suitable for the replacement work. Then, a maintenance technician removes the heating roller from the fixing device and replaces it with a new heating roller. Such replacement and maintenance work include time for cooling down the heating roller, and the work efficiency becomes low. In addition, since the down time of the image forming apparatus increases, the operational efficiency of the image forming apparatus is degraded and the cost burden for the replacement and maintenance work increases.

In recent years and continuing, it is required for image forming apparatuses to have abilities of high-speed printing, high-quality image reproduction and compatibility with various types of recording media. The fixing device is also required to deal with such demands and several types of heating rollers are used depending on the purposes. For example, a PFA coated heating roller (coated with a thin film of tetrafluoroethylene-perfluoroalkyl vinyl ether copolymer resin) is used aiming at promptly supplying heat required for fixing toner images. To achieve a high-image quality, a heating roller coated with silicon rubber is used to prevent the toner image from darkening and blurring during the fixing process. When durability is emphasized, while achieving a certain degree of image quality, a heating roller coated with a PFA tube over the silicon rubber layer is used.

FIG. 1 is a cross-sectional view of a conventional fixing device and FIG. 2 is a perspective view of replacement of a heating roller disclosed in, for example, WO 91/09351.

As illustrated in FIG. 1, one end of the heating roller 100 is supported via a bearing flange 101 at a frame 102. The bearing flange 101 has a bearing 103 which is fit, together with a centering member 104, into the opening of the heating roller 100. Although not shown in the figure, the other end of the heating roller 100 is also supported at a bearing flange via a bearing.

The bearing flange 101 is fixed to the frame 102 by means of a wing screw 106. A retaining claw 108 is fixed to the bearing flange 101 by means of a wing screw 107. The retaining claw 108 functions to fix the heating roller 100 when replacing the heating roller 100 with a new one.

A lamp cartridge with multiple heater lamps is placed in the heating roller 100. One end of the lamp cartridge is held at the center of the bearing flange 101 via the retaining member 109. Although not shown in the figure, the other end of the lamp cartridge 105 is also held indirectly at the bearing flange 101 via a retaining member.

A connector 110 provided at the end of the lamp cartridge 105 holds the lamp cartridge 105 at the center of the bearing flange 101, and projects from the bearing flange 101 outward. The bearing flange 101 is furnished with a grip 111 for replacement of the heating roller 100 as a single unit. The grip 111 is positioned over the connector 110 of the lamp cartridge 105 projecting from the bearing flange 101.

When replacing the heating roller 100, prior to the replacement, the connector 110 projecting from the bearing flange 101 of the lamp cartridge 105 is gripped and pulled out along the axis of the heating roller 100. Then, as illustrated in FIG. 2, the wing screw 106 is loosened, and the heating roller 100 is pulled out from the frame 102, together with the bearing flange 101, while the grip 111 is gripped by a hand. To prevent the heating roller 100 from touching the frame 102 when passing through the opening of the frame 102, felt is applied to the periphery of the opening of the frame 102 so as not to scratch the heating roller 100.

The lamp cartridge 105 with multiple heater lamps has to be removed prior to the replacement of the heating roller 100. Since the lamp cartridge 105 is longer than the heating roller 100 and easily broken, it has to be treated carefully during the removal and the insertion.

The heating roller 100 used in this type of fixing device has a cylindrical shape with a diameter of 100 mm and a length of 500 mm, and is considerably heavy by itself.

Under such circumstances, a maintenance technician grips by one hand the grip 111, while supporting the heating roller 100 by the other hand wearing a glove 120, to pull out the heating roller 100, together with the bearing flange 101, from the frame 102 for the replacement of the heating roller 100. During the replacement, the motion may become unstable due to the weight and the heat of the heating roller 100. Accordingly, the heating roller 100 is likely to come in contact with the other parts, such as the frame 102, during the replacement, and be damaged or subjected to scratches on the surface of the roller.

The position of the heating roller 100 is unstable during the replacement. Besides the heating roller 100 is held by a gloved hand without using an aiding device in the prior art method. The maintenance technician may suffer burns if touching the high-temperature heating roller 100, and the glove 120 gets dirty due to the mold lubricant or the grease adhering on the heating roller 100. Thus, the operability is degraded.

In addition, when the maintenance technician pulls out the heating roller 100 together with the bearing flange 10 from the frame 102 by holding the grip 111 by one hand, the opening of the frame 102 and the inside of the retaining member 130 are covered with felt so as to protect the roller surface from being damaged due to undesirable contact with the frame 102. However, since the heating roller 100 contaminated by the mold lubricant or the grease slides over the felt, the felt is stained by grease builtup and insufficient for protecting the surface of the heating roller 100.

Felt has to be attached and removed every time the heating roller 100 is replaced, which makes the replacement work troublesome. Since felt is stained every time the heating roller 100 is replaced, disposal of the old felt and arrangement of new felt are required.

A structure for preventing breakage when pulling out the lamp cartridge 105 is proposed by JP 2002-23535 A. FIG. 3 is a cross-sectional view of a heating roller from which a lamp cartridge 127 is to be pulled out.

When pulling out the lamp cartridge 127 from a heating roller 114, an operator is positioned behind the image forming apparatus (on the side of a second lamp holder 129 shown in FIG. 3) to insert a lamp-protection cylinder member 164 through a hole 159*a* formed in a housing 159. The inner periphery of the end of the cylinder member 164 is fit into a protector holding unit 130 provided to the first lamp holder 128, whereby the cylinder member 164 is held to protect the lamp.

When the cylinder member 164 has been set, the operator moves to the front of the image forming apparatus (on the side of the first lamp holder 128 in FIG. 3) to take off the restriction member 165 from a recess (not shown) to release the restriction on the movement of the lamp cartridge 127 in the axial direction. In this state, the lamp cartridge 127 is pulled out together with the cylinder member 164 from the heating roller 114.

This method can prevent breakage of the lamp cartridge 127 during the insertion and the pullout, and handling ability is improved. However, the lamp cartridge 127 has to be removed prior to replacement of the heating roller 114, and the work efficiency is not satisfactory.

Thus, the fixing device disclosed in WO 91/09351 has defects in that the lamp cartridge has to be removed and refixed before and after the replacement of the heating roller. This work increases the number of steps of the replacement process and makes the replacement work cumbersome.

The method disclosed in JP 2002-23535 A can improve the safety in the insertion and pullout of the lamp cartridge; however, complication of the work sequence has not been solved yet.

DISCLOSURE OF INVENTION

The objective of the present invention is to solve the problems in the prior art techniques and to provide a fixing device and an image forming apparatus using such a fixing device that allow simple and safe replacement of the heating roller.

To achieve the objective, as the first means for solving the technical problem, a fixing device is provided, which comprises a heating roller; a pressure roller configured to be pressed against the heating roller; a lamp cartridge having a plurality of heater lamps arranged in the heating roller, a first lamp holder for holding first ends of the heater lamps, and a second lamp holder for holding other ends of the heater lamps; a frame having an opening to allow replacement of the heating roller; and a retaining member for retaining the heating roller against the frame, while holding the lamp cartridge at the center of the heating roller, and configured to close the opening of the frame, wherein the first lamp holder is placed in the inner periphery of the retaining member, and interlock means that allows locking and unlocking between the first lamp holder and the retaining member is provided, and wherein when replacing the heating roller, the retaining member is unlocked from the first lamp holder, and the retaining member and the heating roller are pulled out from the opening of the frame, while leaving the lamp cartridge in the fixing device.

As the second means, a fixing device is provided, which comprises a heating roller; a pressure roller configured to be pressed against the heating roller; a lamp cartridge having first lamp holder for holding first ends of multiple heater lamps serving as heat sources and a second lamp holder for holding other ends of the heater lamps inside the heating roller; a retaining member for retaining the heating roller and the lamp cartridge against the frame, the retaining member having a lamp cartridge retention unit configured to retain the lamp cartridge at the center of the heating roller; and a fixing mechanism for heating and pressing a recording medium on which a unfixed toner image is formed, while nipping and transporting the recording medium between the heating roller and the pressure roller, to fix the toner image onto the recording medium, the heating roller being arranged so as to be replaceable in the axial direction, wherein the outer diameter of the second lamp holder is substantially the same as the inner diameter of a roller insert/pullout guide shaft which is inserted into the heating roller in an attachable and detachable manner when replacing the heating roller, wherein the outer diameter of the roller insert/pullout guide shaft is substantially the same as the outer diameter of the first lamp holder, wherein the first lamp holder has an interlock member configured to engage the first lamp holder with the roller insert/pullout guide shaft, and wherein the fixing device has a stopper configured to constrain the movement of the roller insert/pullout guide shaft in the axial direction.

As the third means, multiple protection members for protecting the heater lamps are provided inside the roller insert/pullout guide shaft along the entirety of the inner circumference of the roller insert/pullout guide shaft or along the axial direction of the roller insert/pullout guide shaft.

As the fourth means, the roller insert/pullout guide shaft is formed of a metallic material.

As the fifth means, the fixing device further comprises a heating roller cover arranged inside an opening of the heating roller near the end of the heating roller, wherein the heating roller cover has a through-hole at the center for allowing the roller insert/pullout guide shaft to pass through the heating roller cover, and the inner diameter of the through-hole is substantially the same as the outer diameter of the roller insert/pullout guide shaft.

As the sixth means, the retaining member has a through-hole which serves as a lamp cartridge retention means, and the inner diameter of the lamp cartridge retention means (i.e., the through-hole) is substantially the same as the outer diameter of the roller insert/pullout guide shaft and the outer diameter of the first lamp holder.

As the seventh means, a heating roller coupling member for coupling the heating roller with the retaining member and an attaching/detaching handle are further provided, and the retaining member and the heating roller are structured as a single unit.

As the eighth means, an assisting unit for assisting a pullout operation of the heating roller is coupled to a leading end of the heating roller along the pullout direction, and the assisting unit has a coupling unit for coupling the assisting unit with the heating roller and an attaching/detaching handle.

As the ninth means, an image forming apparatus having a fixing device for fixing an unfixed toner image onto a recording medium is provided. The fixing device is one described as the first through the eighth means.

The above-described arrangements can achieve a fixing device and an image forming apparatus using the fixing device which allow replacement of the heating roller in a simple and safe manner.

DETAILED DESCRIPTION OF THE EMBODIMENTS

The preferred embodiments of the present invention will now be described below in conjunction with the attached drawings <Overall Structure of Laser Beam Printer>

Figure 1:
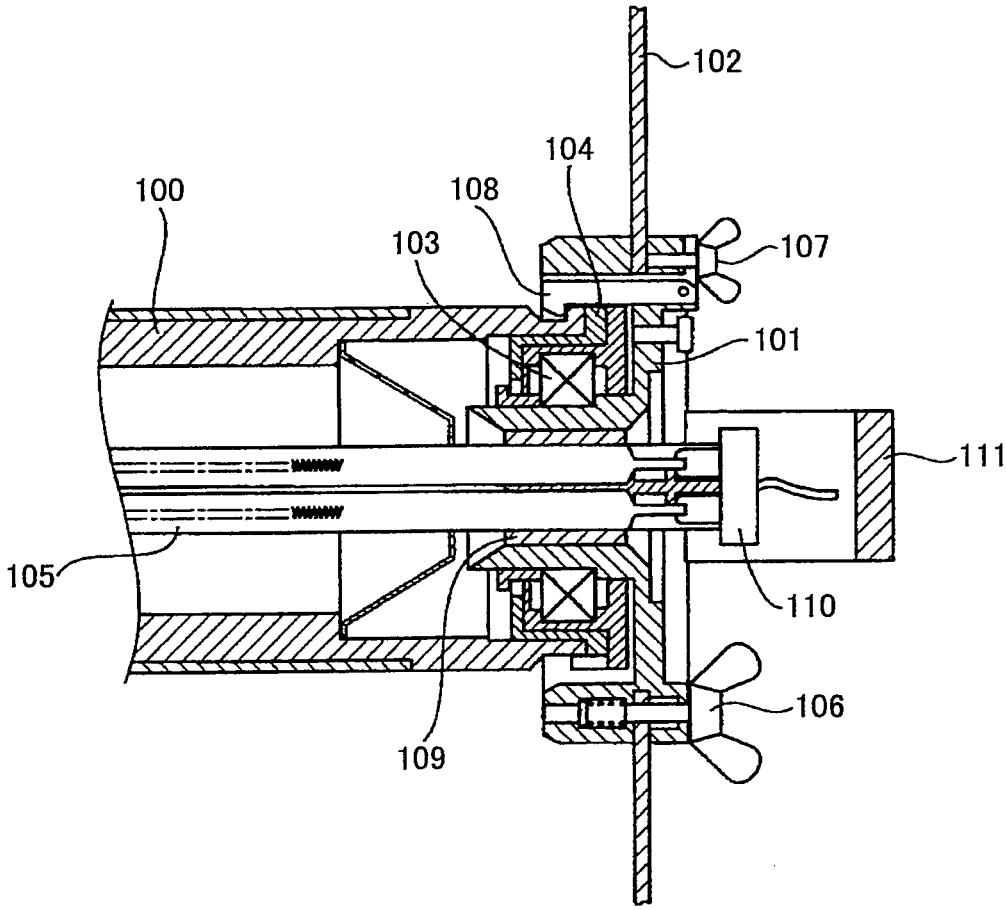
FIG.1 PRIOR ART
FIG. 1 is a cross-sectional view of a part of a conventionally proposed fixing device.
Figure 2:
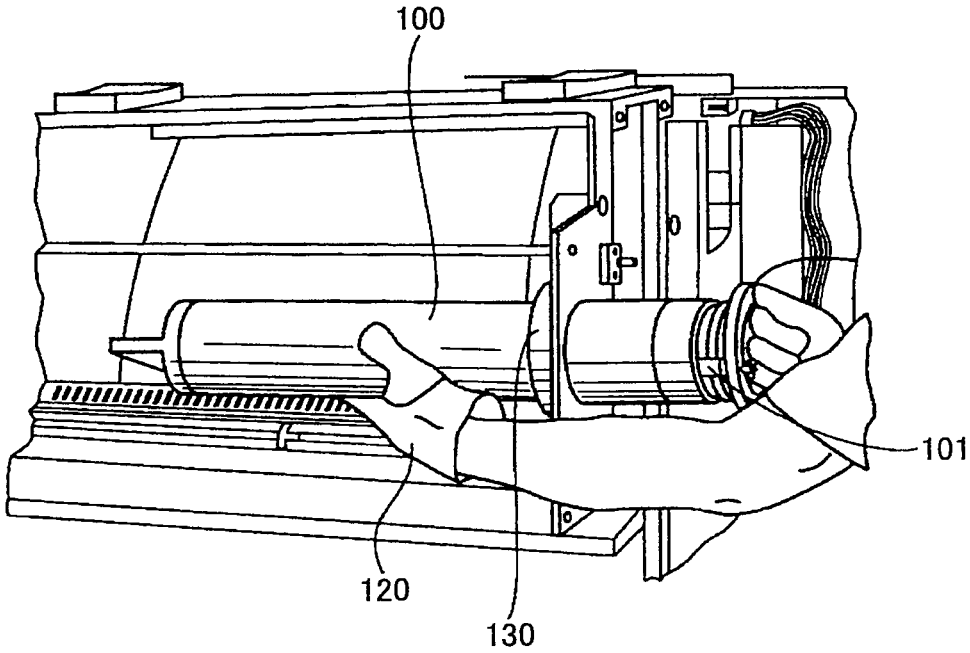
FIG.2 PRIOR ART
FIG. 2 is a perspective view illustrating replacement of the heating roller of the conventional fixing device.
Figure 3:
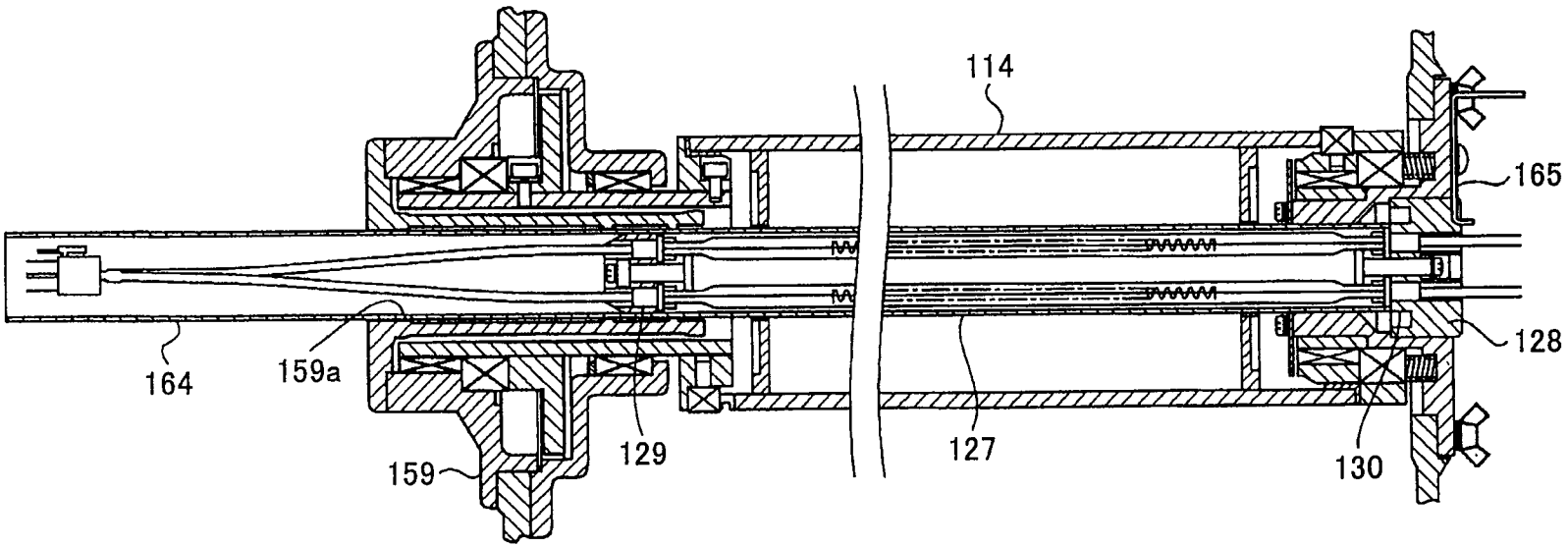
FIG.3 PRIOR ART
FIG. 3 is a cross-sectional view of a structure of another prior art technique for puling out the lamp cartridge.
Figure 4:
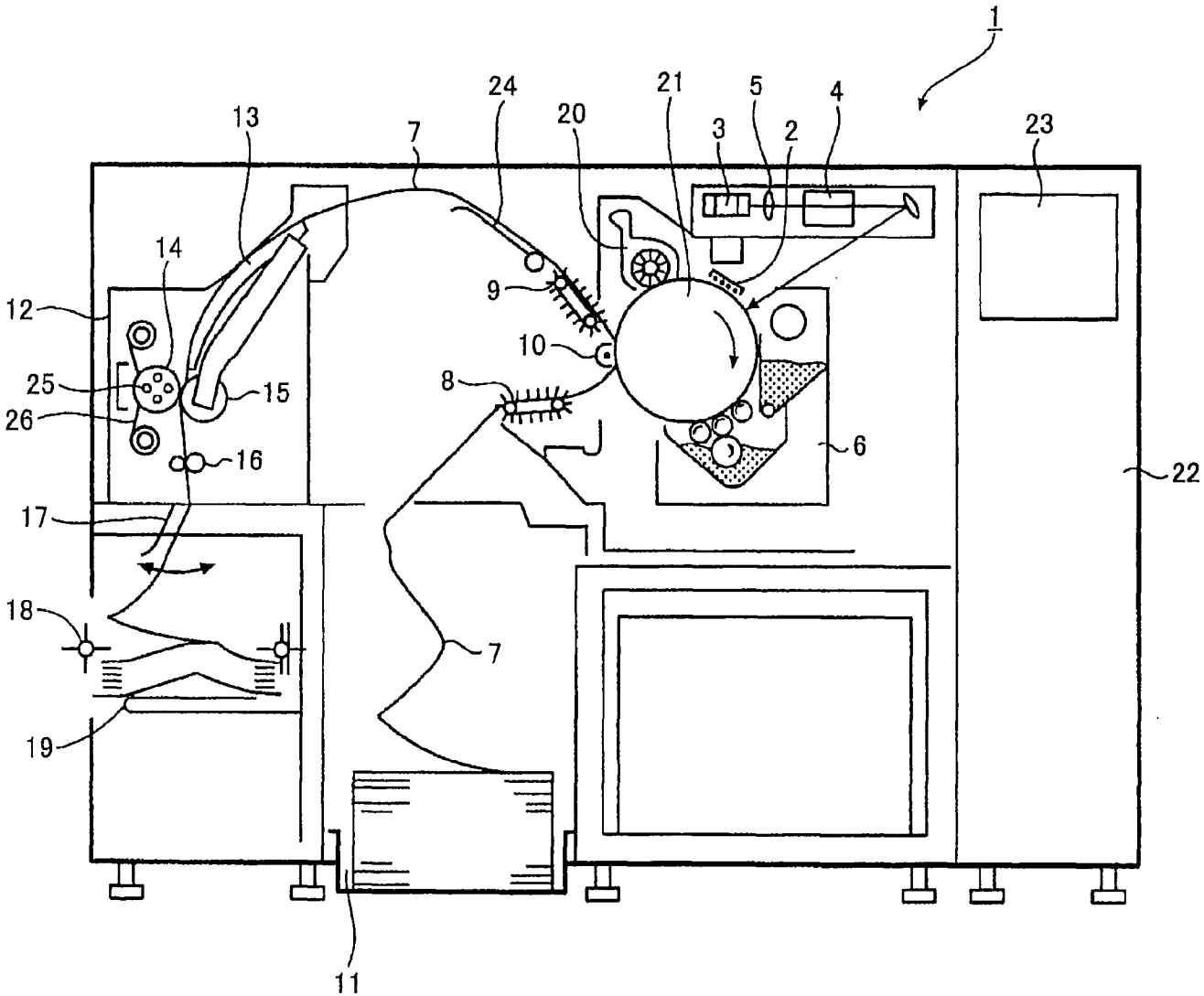
FIG. 4 is a schematic diagram of an image forming apparatus according to an embodiment of the invention.

First, explanation is made of the overall structure of an electrophotographic laser beam printer to which the present invention is applied, with reference to FIG. 4.

In a laser beam printer 1, a photoconductive drum 21 rotates in the arrowed direction in response to the printing operation start signal supplied from the controller 22. The photoconductive drum 21 rotates at a speed corresponding to the printing rate of the laser beam printer 1 and continues to rotate until the printing operation is finished. When the photoconductive drum 21 starts rotating, a high voltage is applied to a corona charger 2 and the surface of the photoconductive drum 21 is uniformly charged with, for example, positive electric charges.

A rotating polygon mirror 3 starts rotating immediately after the power-on of the laser beam printer 1, and the constant-speed rotation is maintained at high accuracy during the power-on state. The light beam emitted from a light source 4 such as a semiconductor laser is reflected from the rotating polygon mirror 3 and guided through an fθ lens 5 onto the surface of the photoconductive drum 21 to irradiate the photoconductive drum 21, while scanning on the surface. When character data or graphic data converted into a dot image are supplied as on/off signals for the laser beam from the controller 22 of the laser beam printer 1, a so-called electrostatic latent image is formed on the photoconductive drum because areas irradiated by the laser beam and non-irradiated areas are created on the surface of the drum.

When the electrostatic latent image formed in a particular area on the photoconductive drum 21 comes to the right position facing a developing unit 6, toner particles are supplied onto the electrostatic latent image. For example, positively charged toner particles are attracted to the areas in which the electric charges were caused to disappear due to the irradiation of the laser beam, and consequently, a toner image is formed on the photoconductive drum 21.

Continuous-feed paper or fanfold paper 7 accommodated in a paper hopper 11 is transported by a paper feed tractor 8 to the position between the photoconductive drum 21 and a transfer device 10, synchronized with the timing of the toner image formed on the photoconductive drum 21 reaching the transfer position. The toner image formed on the photoconductive drum 21 is attracted to the paper 7 by means of the transfer device 10 that gives electric charges polarized opposite to the toner image to the back of the paper 7.

The paper 7 is transported by the paper feed tractor 8 to a fixing device 12 via the transfer device 10, the paper feed tractor 9 and a buffer plate 24. The paper 7 having reached the fixing device 12 is preheated by a pre-heater 13 which has multiple heaters inside. Then, the paper 7 is nipped and further transported by the nip unit having a pair of fixing rollers consisting of a heating roller 14 with multiple heater lamps 25 inside and a pressure roller 15. Heat and pressure are applied to the paper 7 during the feeding by the nip unit to fuse and fix the toner image onto the paper 7.

The paper fed by the heating roller 14 and the pressure roller 15 is further transported by a paper feed roller 16 to a stacker table 19, and fan-folded along perforations by the swinging motion of a swing fin 17. The paper 7 is stacked up on the stacker table 19, while a fold state is fixed up by a rotating paddle 18. The paper feed path after the transfer position of the photoconductive drum 21 is cleaned by a cleaning unit 20 in preparation for the next printing operation.

The buffer plate 24 absorbs slack or tension of the paper 7 when the paper feed speed differs between the paper feed tractor 9 and the fixing rollers (i.e., the heating roller 14 and the pressure roller 15). A display panel 23 displays status information of the laser beam printer 1 being in the printing operation. A web member 26 is provided so as to be capable of making contact with and being rewound from the surface of the heating roller 14 to apply mold lubricant or grease onto the surface of the heating roller 14.

<Structure around Heating Roller>

Figure 5:
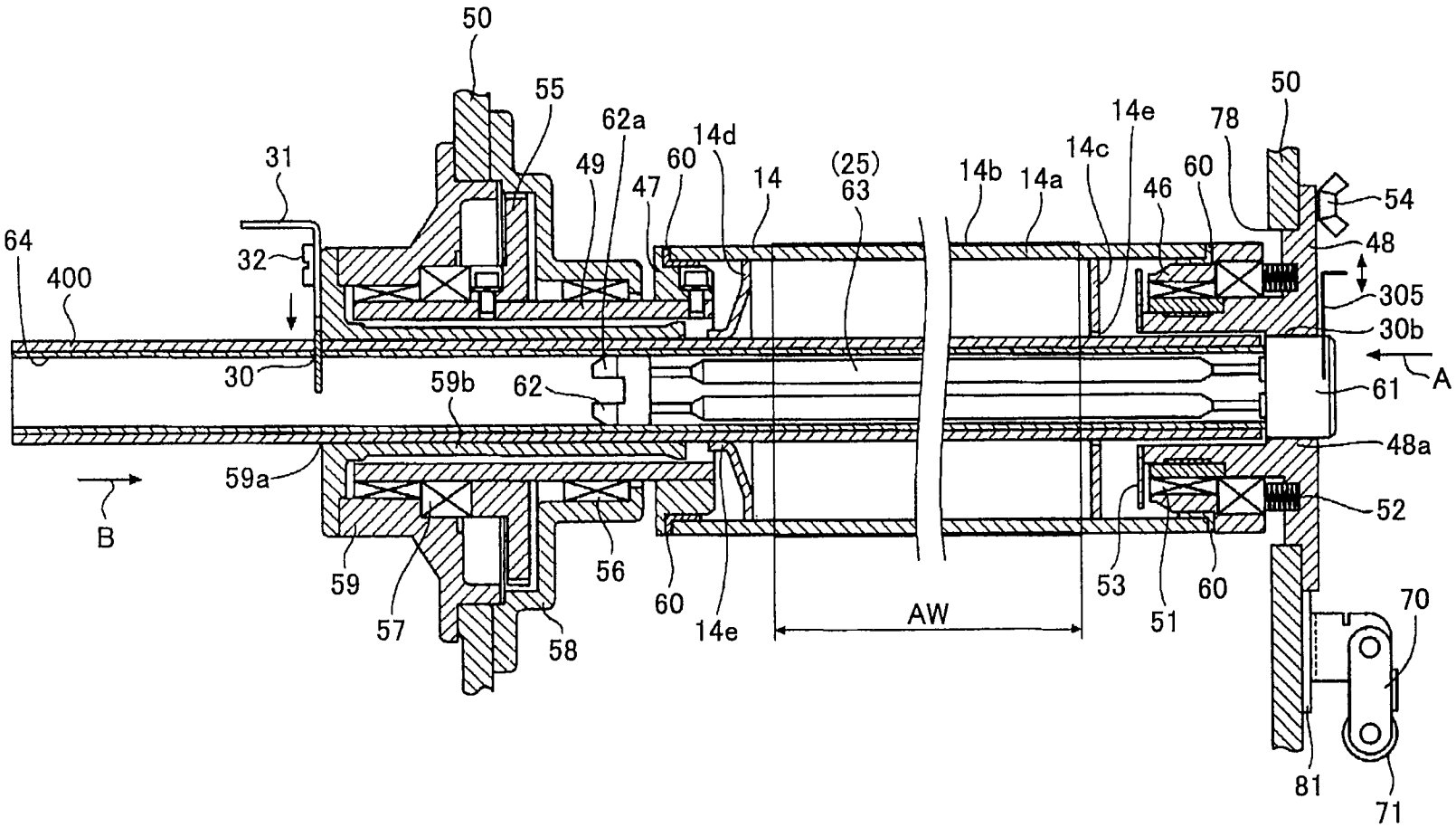
FIG. 5 is a cross-sectional view of a heating roller with a roller insert/pullout guide shaft inserted in it according to an embodiment of the invention.

Next, explanation is made of the structure around the heating roller 14 of the fixing device 12, in conjunction with FIG. 5. The heating roller 14 includes a metallic tube 14*a* made of, for example, aluminum, and a surface layer 14*b* provided on the tube 14*a* over the paper path region AW. The surface layer 14*b* is, for example, a PFA (tetrafluoroethylene-perfluoroalkyl vinyl ether copolymer) resin coat, a silicon rubber layer, or a combination of the silicon rubber layer and the PFA tube covering the silicon rubber.

Disc type heating roller covers 14*c* and 14*d* made of, for example, aluminum are provided inside the heating roller 14 near the openings at both ends of the roller. The heating roller covers 14*c* and 14*d* serve to maintain the surface temperature of the heating roller 14 by preventing the radiation heat of the heater lamps 25 inserted in the heating roller 14 from emanating out of the heating roller 14, and also function as radiation stoppers to prevent the temperature in the machine from elevating. In this regard, the heating roller covers 14*c* and 14*d* are called absorbers 14*c* and 14*d*.

As illustrated in this figure, the distance between the absorbers 14*c* and 14*d* is slightly greater than the length of the paper path region AW in the axial direction. The length of each of the heater lamps 25 is slightly greater than the distance between the absorbers 14*c* and 14*d*.

If a part or all of the absorbers 14*c* and 14*d* reside within the paper path region AW, it is a concern that radiation heat transferred from the heater lamps 25 may be disturbed by the absorbers 14*c* and/or 14*d* and the surface temperature of the heating roller 14 may not reach the desired temperature. To avoid such situations, the absorbers 14*c* and 14*d* are positioned outside the paper path region AW. Each of the absorbers 14*c* and 14*d* has a though-hole 14*e*, through which a lamp cartridge 63 is inserted. Both ends of the heating roller 14 are supported at the corresponding frames 50 of the fixing device 12 by means of retaining members 48 and 49 having centering members 46 and 47, respectively.

The retaining member 48 is furnished with the centering member 46 via a bearing 51, and the centering member 46 is inserted in one of the openings of the heating roller 14. The bearing 51 is adapted to absorb the variation in thermal expansion of surrounding components of the heating roller 14, by means of multiple springs 52 arranged along the circumference and a stopper plate 53 fixed to the end of the inner face of the retaining member 48. With the heating roller 14 assembled into the fixing device, the springs 52 are slightly pressed, and a gap is formed between the stopper plate 53 and each of the centering member 46 and the bearing 51, as illustrated in FIG. 5. The retaining member 48 is fixed to one of the frames 50 via multiple wing screws 54.

The retaining member 49 is furnished with a gear 55 which receives a driving force from a motor (not shown) for rotationally driving the heating roller 14. The retaining member 49 is supported in a rotational manner by housings 58 and 59 via the bearings 56 and 57.

A key groove (not shown) extending in the axial direction is formed at the end of the opening of the heating roller 14 facing the centering member 47. The centering member 47 is furnished with a key (not shown) which fits into the key groove. The heating roller 14 and the centering member 47 are coupled with each other via the key structure. Accordingly, the driving force of the motor for rotating the heating roller 14 is transferred via the gear 55, the retaining member 49, the centering member 47 and the key structure to the heating roller 14, thereby causing the heating roller 14 to rotate in a prescribed direction.

To prevent heat flowing from the heating roller 14 to the centering members 46, 47 and damage on the heating roller 14, rings 60 are inserted between the heating roller 14 and the centering members 46, 47 at corresponding ends of the heating roller 14. A cutout (not shown) is formed in the ring 60 at a position corresponding to the key groove of the heating roller 14 so as to allow the connection between the key and the key groove.

Multiple heater lamps 25 serving as heat sources of the heating roller 14 are held together by a first lamp holder 61 and a second lamp holder 62 one at each end of the heater lamps 25 to constitute the lamp cartridge 63. The feeder wires at both ends of each of the heater lamps 25 pass through the first and second lamp holders 61 and 62 so as to be externally connected. The lamp cartridge 63 is positioned at the center of the heating roller 14 as shown in FIG. 5.

Figure 7A:
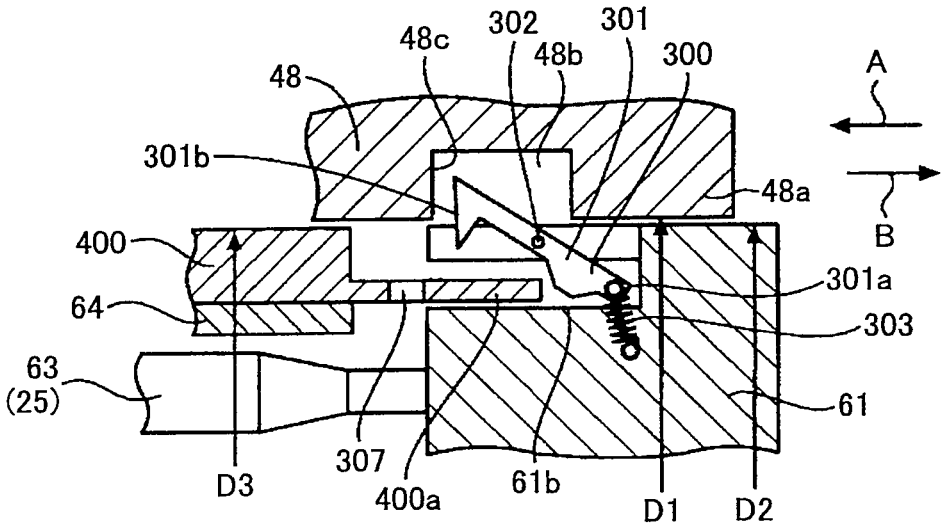
FIG. 7A through FIG. 7D are partially enlarged cross-sectional views illustrating locking and unlocking of the lamp cartridge.

As illustrated in FIG. 7A, an inner diameter D1 of the retaining member 48 at the inner part 48*a* facing the first lamp holder 61 is substantially the same as an outer diameter D2 of the first lamp holder 61. An outer diameter D3 of a roller insert/pullout guide shaft 400, the details of which will be described below, is substantially the same as the inner diameter D1 of the retaining member 48 and the outer diameter D2 of the first lamp holder 61. Accordingly, the relationship between D1, D2 and D3 is expressed as D1≈D2≈D3. With this arrangement, the retaining member 48 (the heating roller 14) can be pulled out of or inserted into the image forming apparatus, while leaving the first lamp holder 61 (the lamp cartridge 63) inside the image forming apparatus, when replacing the heating roller 14.

<Structure of Heating Roller Replacement Aid>

Next, explanation is made of a replacement aid for the heating roller 14. The replacement aid of the embodiment includes the roller insert/pullout guide shaft 400, an assisting unit 40 (FIG. 10), and a bearing roller unit 70.

The roller insert/pullout guide shaft 400 is a rigid cylinder made of, for example, a metal. The length of the roller inset/pullout guide shaft 400 is slightly greater than the distance between the frames 50, as illustrated in FIG. 5. The outer diameter of the roller insert/pullout guide shaft 400 is substantially the same as the inner diameter of the retraining member 48, the inner diameter of one absorber 14*d*, and the inner diameter of an inner cylinder 59*b* of the housing 59.

A plate-like stopper 31 is held at the side wall of the housing 59 in a slidable fashion by the pin 32 to fix the roller insert/pullout guide shaft 400. As illustrated in FIG. 5, a receiving slot 30 is formed in the wall of the roller insert/pullout guide shaft 400 so as to receive the stopper 31 when the roller insert/pullout guide shaft 400 is inserted to a prescribed position.

By fixing (locking) the roller insert/pullout guide shaft 400 by the stopper 31 at a prescribed position, the roller insert/pullout guide shaft 400 can be maintained at the right position without positional shift in the axial direction when removing and inserting the heating roller 14, the retaining member 48 and the assisting unit 40. Accordingly, removal and insertion of each of these components can be carried out smoothly, while holding the roller insert/pullout guide shaft 400 in a rotational manner.

Figure 10:
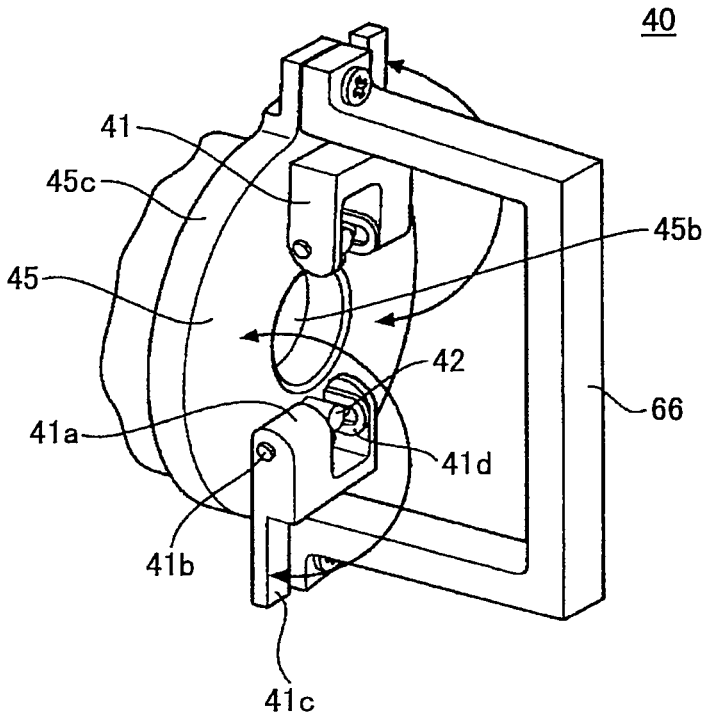
FIG. 10 is a perspective view of a part of the assisting unit used in the embodiment of the invention.
Figure 11A:
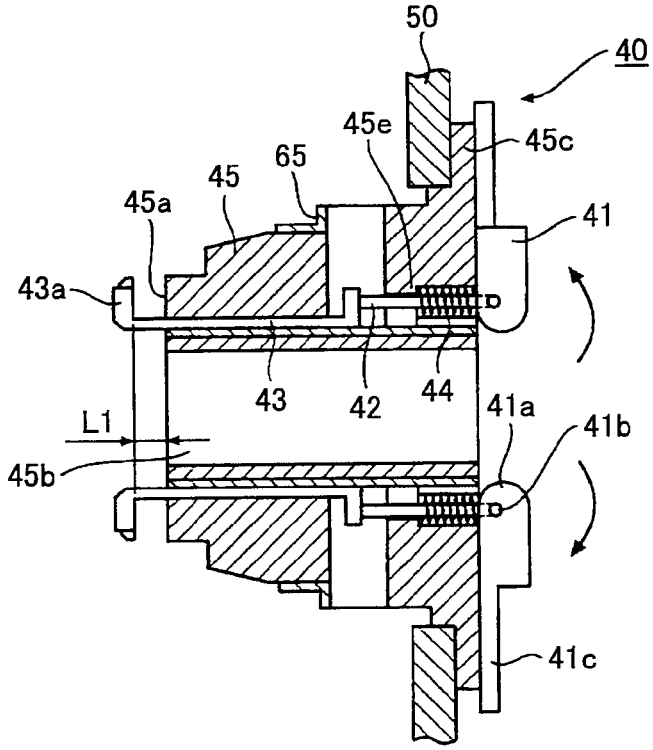
FIG. 11A and FIG. 11B are cross-sectional views illustrating motions of the assisting unit.
Figure 11B:
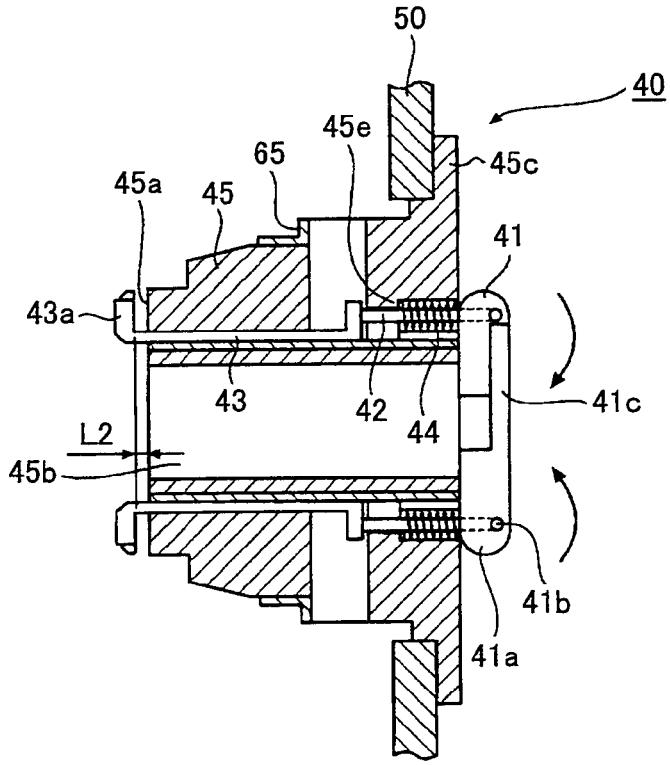

FIG. 10 illustrates the assisting unit 40. The assisting unit 40 includes an assisting unit main body 45, two latches 41 attached to the side wall of the assisting unit main body 45 in a pivotable manner, shafts 42 for transferring the motions of the latches 41 to holders 43 (see FIG. 11A and FIG. 11B), and a handle 66 fixed to the wall of the assisting unit main body 45. As illustrated in FIGS. 11A and 11B, one end of the holder 43 is coupled with the shaft 42 and the other end of the holder 43 is bent outwardly. A coil spring 44 is provided around the shaft 42 to absorb the component tolerance and secure the attachment of the heating roller 14. A through-hole 45*b* is formed at the center of the assisting unit main body 45, which through-hole 45*b* is extending in the axial direction of the assisting unit main body. The assisting unit main body 45 has a flange 45*c* at one end, and a ring 65 is provided at a position that comes into contact with the opening of the heating roller 14 when replacing the heating roller 14. The inner diameter of the through-hole 45*b* is substantially the same as the outer diameter of the roller insert/pullout guide shaft 400.

Returning to FIG. 10, the two latches 41 have the same shapes, and each of them has a pivoting part 41*a* with a half-cylindrical shape at the base end. An axle 41*b* is provided offset inwardly in the pivoting part 41*a*. The opposite side of the pivoting part 41*a* is furnished a lever 41*c*. The two latches 41 are fixed to the assisting unit main body 45 so as to be opposite to each other via the through-hole 45*b*.

As illustrated in FIG. 11A and FIG. 11B, one end of the shaft 42 is connected to the axle 41*b* of the latch 41. The end part of the holder 43 opposite to the other end connected to the shaft 42 is bent so as to face the end wall 45*a* of the assisting unit main body 45. The bent portion forms a clipping piece 43*a*.

The coil spring is positioned between the latch 41 and a stepwise spring receiving part 45*e* formed in the assisting unit main body 45. The shaft 42 is passes through the spring 44. The latch 41 is forced outwardly due to the spring force of the spring 44, and retaining means 41*d* (see FIG. 10) is provided to the latch 41.

In FIG. 11A, the levers 41*c* of the two latches 41 turn outwardly. The axles 41*b* of the latches 41 are positioned near the assisting unit main body 45. Accordingly, the distance L1 between the clipping piece 43*a* of the holder 43 and the end wall 45*a* of the assisting unit main body 45 is large. The distance L1 is slight greater than the thickness of the absorber 14*c*. FIG. 10 also illustrates the two latches 41 with the lever 41*c* turning outwardly separating from each other.

When the latches 41 are operated such that the levers 41*c* are turned inward as illustrated in FIG. 11B, axles 41*b* of the latches 41 move away from the assisting unit main body 45. Along with the shift of the axles 41*b*, the shaft 42 and the holder 43 move, and the distance between the clipping piece 43*a* of the holder 43 and the end wall 45*a* of the assisting unit main body 45 decreases and becomes L2. The distance L2 is slightly less than the thickness of the absorber 14*c*.

The bearing roller unit 70 holds the roller surface when replacing the heating roller 14. As illustrated in FIG. 12A-12F, the bearing roller unit 70 includes a bearing roller 71, a first shaft for supporting the bearing roller 71 in a rotational manner, a roller plate 73 with a free end to which the first shaft 72 is fixed, a second shaft 74 fixed to the base of the roller plate 73, and a holder plate 75 for supporting the second shaft 74 in a rotational manner.

When the heating roller 14 is replaced, the high-temperature heating roller 14 of about 200° C. moves over the bearing roller 71. Therefore, the bearing roller 71 has to be superior in heat resistance and has to be configured not to damage the surface layer 14*b* (see FIG. 5) of the heating roller 14. For these reasons, the bearing roller 71 is made of a material the same as or similar to that of the surface layer 14*b* of the heating roller 14. In this embodiment, the surface layer 14*b* of the heating roller 14 is made of a fluorinated resin, such as PTFE resin (polytetrafluoroethylene resin), PFA resin (tetrafluoroethylene-perfluoroalkyl vinyl ether copolymer resin), or FEP resin (tetrafluoroethylene-hexafluoroprophylene copolymer resin), and the bearing roller 71 is also made of a material same as or similar to these materials.

To prevent the bearing roller 71 from damaging the surface of the heating roller 14 when the heating roller 14 passes over the rotating bearing roller 71, the bearing roller 71 is shaped into a drum such that the surfaces of the heating roller 14 and the bearing roller 71 come into point contact with each other.

A hook 76 is integrally formed in one side of the roller plate 73 by bending. A groove 77 (see FIG. 12E) is formed in the holder plate 75 so as to receive the hook 76. The width of the groove 77 is substantially the same as the thickness of the hook 76. An elongated hole 75*a* is also formed in the holder plate 75 (FIGS. 12A, 12C and 12E) extending parallel to the depth direction of the groove 77. The second shaft 74 passes through the elongated hole 75*a*, and the roller plate 73 is held movable along the elongated hole (upward and downward in the figure), as will be described below.

Figure 12A:
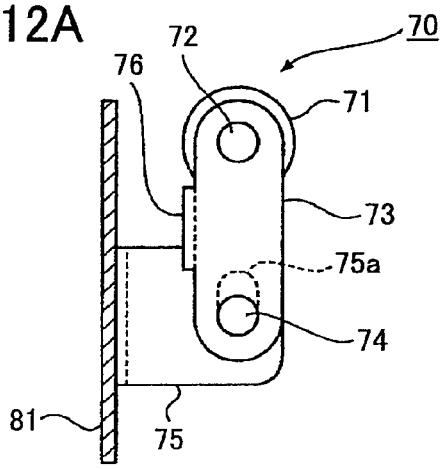
FIG. 12A through FIG. 12F are side views and plan views illustrating the motions of the bearing roller used in the embodiment of the invention.
Figure 12B:
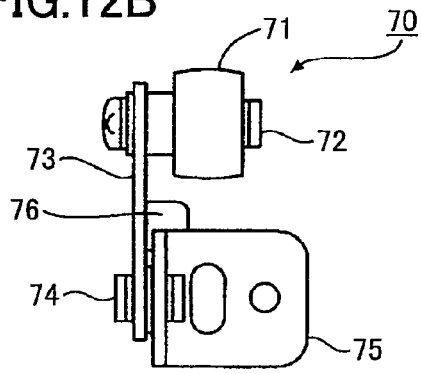

FIG. 12A is a side view and FIG. 12B is a plan view of the bearing roller unit 70 in the working state during the pullout or the insertion of the heating roller 14. In FIG. 12A, the hook 76 formed in the roller plate 73 is fit into the groove 77 of the holder plate 75 (in the locked state). The roller plate 73 is kept at the rising state, and the bearing roller 71 is adjacent to an opening 78 of the frame 50 through which the heating roller 14 is replaced.

Figure 12C:
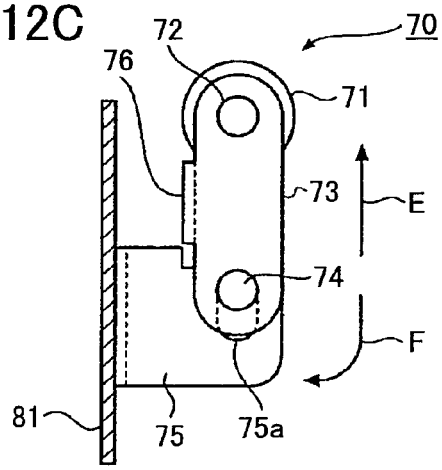
Figure 12D:
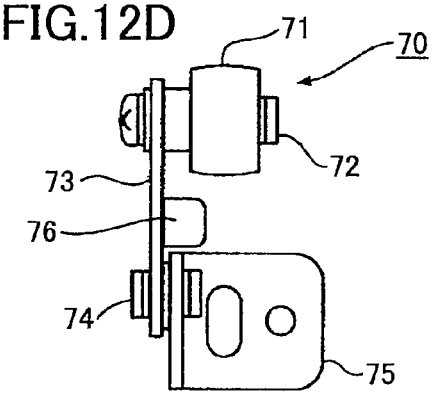

FIG. 12C is a side view and FIG. 12D is a plane view of the bearing roller unit 70 on the way to the home position (standby position) from the working position described above. In FIG. 12C, the hook 76 is disengaged from the groove 77 (in the unlocked state) by picking the roller plate 73 up in the direction E. Then, the roller plate 73 is rotated about the second shaft 74 by 180 degrees in the direction F.

Figure 12E:
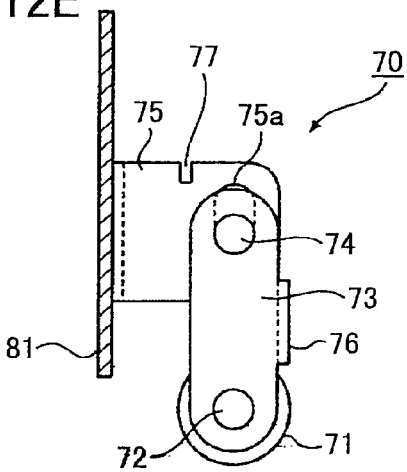
Figure 12F:
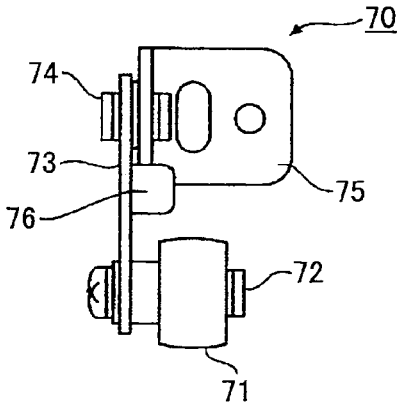

FIG. 12E is a side view and FIG. 12F is a plane view of the bearing roller unit 70 at the standby position. In this state, the roller plate 73 is hung from the second shaft 74, and the bearing roller 71 is positioned at the bottom apart from the opening 78 of the frame 50 (see FIG. 5).

Figure 13:
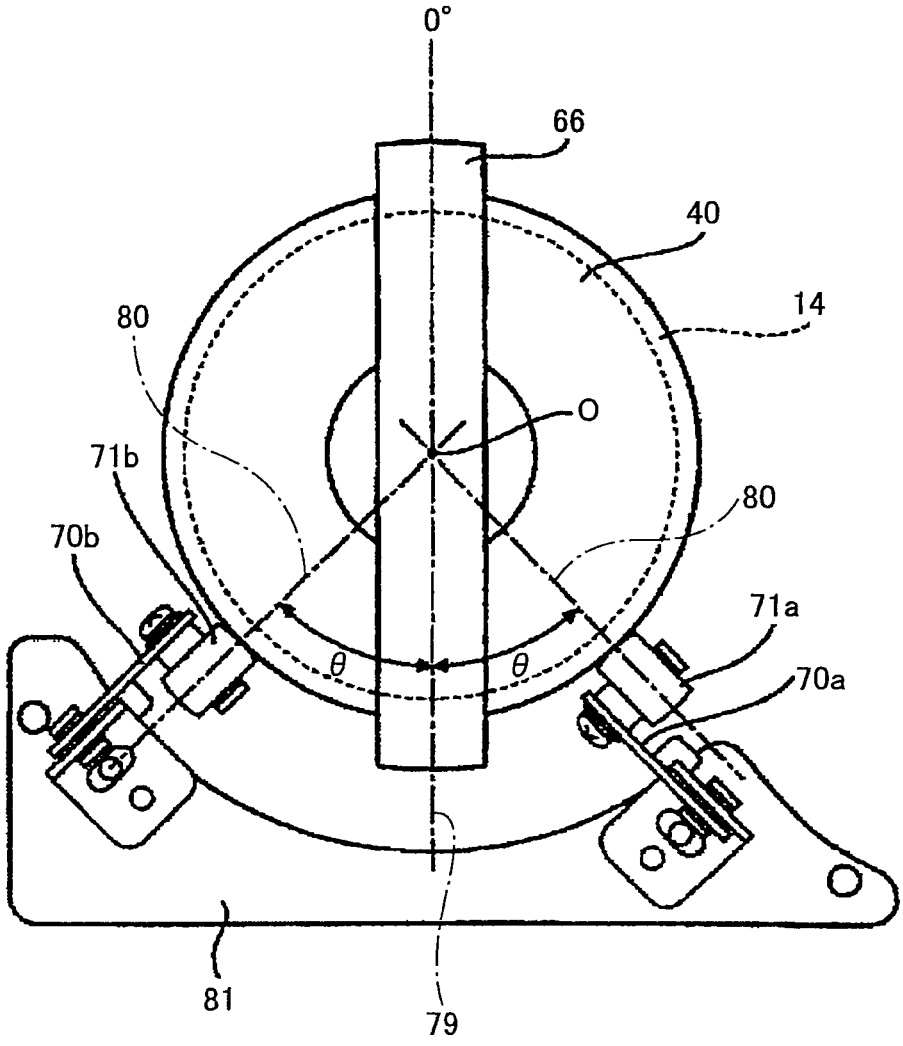
FIG. 13 illustrates the positions of two bearing rollers with respect to the assisting unit according to the embodiment of the invention.
Figure 15:
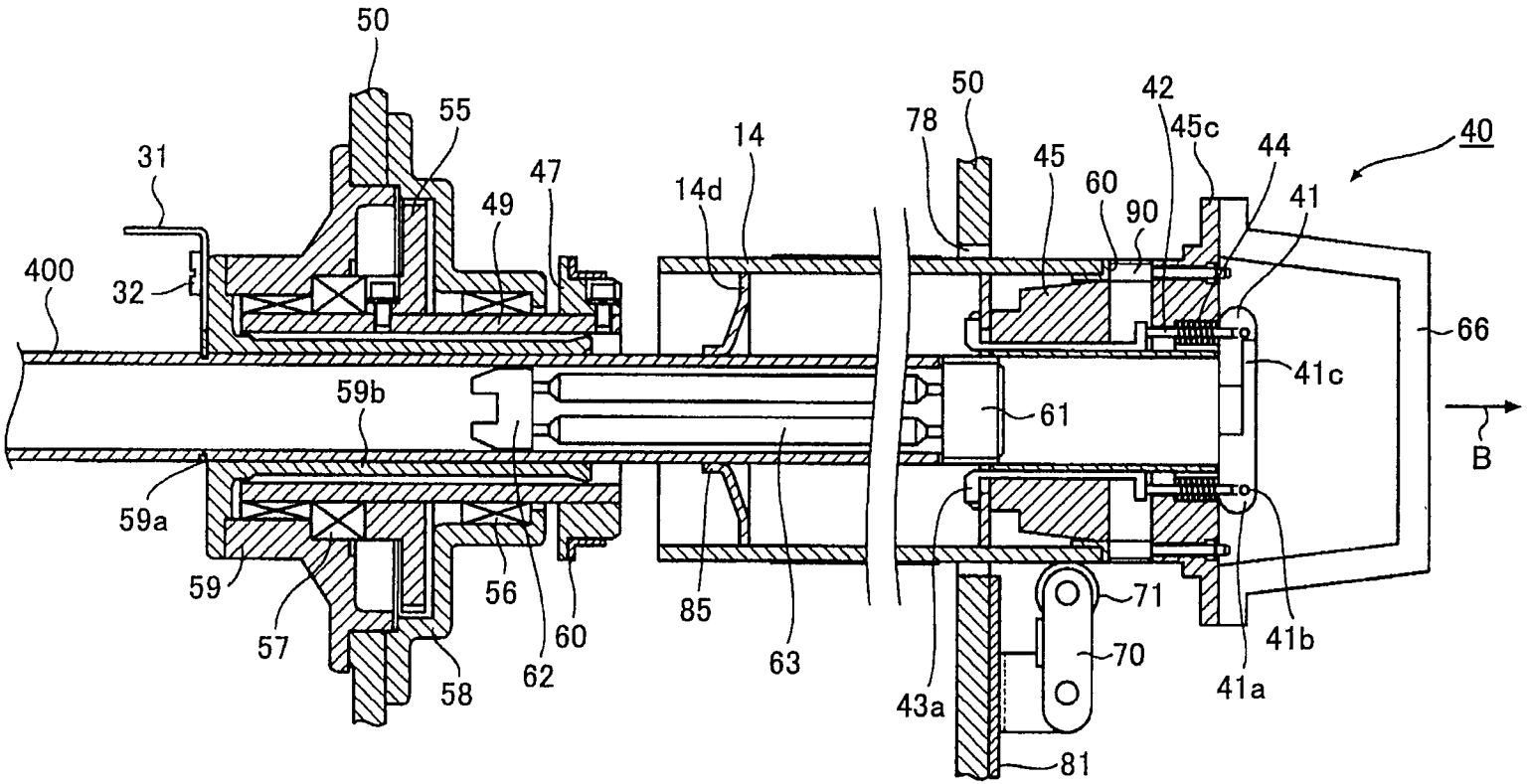
FIG. 15 is a cross-sectional view of the heating roller which is being pulled out from the fixing device.

FIG. 13 illustrates the position of the bearing roller units 70 with respect to the assisting unit 40. In this embodiment, two bearing roller units 70*a* and 70*b* are used, which are placed at appropriate positions that allow a smooth pullout operation of the heating roller 14 near the opening 78 of the frame 50, as illustrated in FIG. 15, with the handle 66 of the assisting unit 40 gripped by a hand.

To be more precise, assuming that the vertical line 79 passing through the roller center of the heating roller 14 is at 0 degrees, the two bearing roller units 70*a* and 70*b* are positioned such that the center lines 80 extending perpendicular to a roller axles of the bearing rollers 71*a* and 71*b* intersect with the vertical line 79 at angles (θ) of ±30 degrees to ±60 degrees, more preferably in the range of ±40 degrees to ±50 degrees (45 degrees in this embodiment), and positioned symmetrically with respect to the vertical line 79. With this arrangement, the pair of bearing roller units 70*a* and 70*b* can support the heating roller 14 in a stable manner, without disturbing the pullout operation, when the heating roller is pulled out of the fixing device using the assisting unit 40. Thus, unstable factors of the pullout operation can be precluded.

A fixing plate 81 is used to fix the bearing roller units 70*a* and 70*b* at the symmetric positions. The bearing roller units 70*a* and 70*b* are fixed outside the frame 50 via the fixing plate 81.

In this embodiment, two bearing roller units 70*a* and 70*b* are placed downside of the heating roller 14; however, additional (one or two) bearing roller units 70*a* and 70*b* may be place upside of the heating roller 14. In this case, the additional bearing roller units have to be positioned so as not to disturb the pullout operation using the assisting unit 40, in the same manner as the downside bearing roller units 70*a* and 70*b*. Besides, a certain amount of gap has to be provided between the upside bearing roller units 70 and the heating roller 14 so as not to constrain the heating roller 14 too much.

Figure 14:
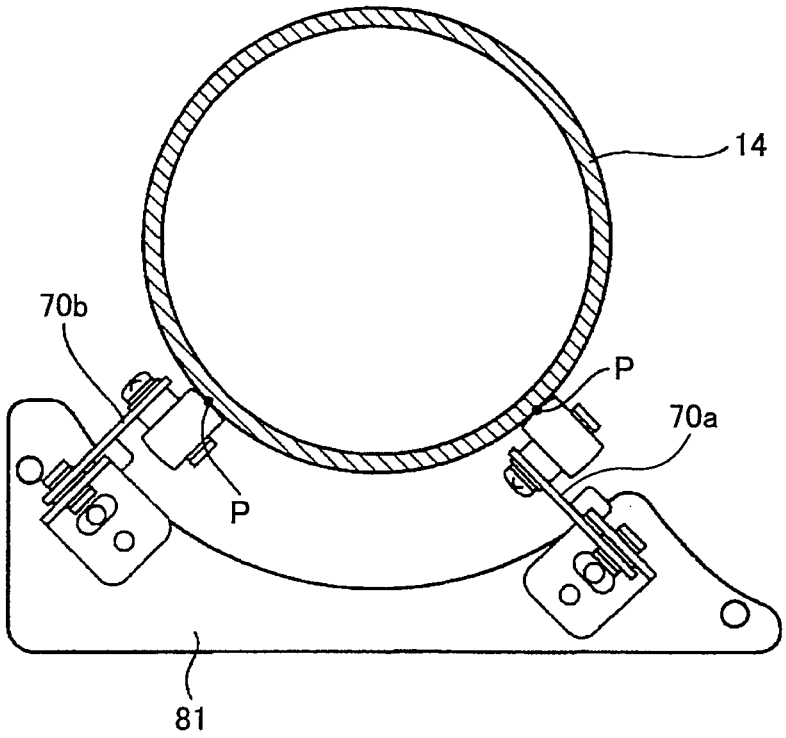
FIG. 14 is a partial cross-sectional view illustrating the heating roller held by the two bearing rollers according to the embodiment of the invention.

FIG. 14 is a cross-sectional partial view of the heating roller 14 supported in a stable manner by the bearing roller units 70*a* and 70*b* during the pullout operation.

<Interlock Structure between Retaining Member and Lamp Cartridge>

Next, explanation is made of the interlock structure between the retaining member 48 and the lamp cartridge 63, with reference to FIG. 5, FIG. 7A through FIG. 7D, and FIG. 8.

As illustrated in FIG. 5, the outer diameter of the first lamp holder 61 is slightly greater than the outer diameter of the second lamp holder 62. Meanwhile, as illustrated in FIG. 7A through 7D and FIG. 8, a lamp cartridge protection member 64, such as a paper tube, is provided at the inner surface of the roller insert/pullout guide shaft 400. Accordingly, the difference between the outer diameter of the first lamp holder 61 and the outer diameter of the second lamp holder 62 is about twice the thickness of the combination of the roller insert/pullout guide shaft 400 and the lamp cartridge protection member 64.

As has been described above, the relationship between the inner diameter D1 of the retaining member 48, the outer diameter D2 of the first lamp holder 61, and the outer diameter D3 of the roller insert/pullout guide shaft 400 is expressed as D1≈D2≈D3 (see FIG. 7A).

As illustrated in FIG. 7A through FIG. 7D, at least one interlock member 300 for coupling the retaining member 48 with the lamp cartridge 63 is arranged at the periphery of the first lamp holder 61. The interlock member 300 includes a hook 301, a pin 302 supporting the middle of the hook 301 along the length in a rotatable manner, and a tension spring 303 connected to a base end 301*a* of the hook 301.

Under the usual condition in which replacement of the heating roller 14 and the lamp cartridge 63 is not required, the hook 301 is held at the uprising position in which the hook 301 is rotated about the pin 302 until the base end 301*a* comes into contact with the bottom face of a dent 61*b* for receiving the roller insert/pullout guide shaft 400. The uprising angle of the hook 301 is about 15 degrees to 90 degrees, more preferably, 45 degrees to 60 degrees, with respect to the axial direction of the lamp cartridge 63.

At the uprising position of the hook 301, a claw 301*b* provided at the end of the hook 301 projects from the outer surface of the first lamp holder 61. Accordingly, a recess 48*b* is formed in the inner face of the retaining member 48 to accommodate the claw 301*b*. Since FIG. 7A through FIG. 7D are enlarged views, the claw 301*b* is illustrated apart from the inner wall 48*c* of the recess 48*b*. However, in the actual structure, they are positioned very close to each other. Therefore, even if a force is applied to the lamp cartridge 63 in the direction A, the claw 301*b* hits the inner wall 48*c* of the recess 48*b*, and the movement in the direction A is prevented. In this manner, the retaining member 48 and the lamp cartridge 63 are interlocked with each other via the interlock member 300.

In FIG. 5, a lamp cartridge clamp 305 is attached to the end face of the retaining member 48 so as to be slidable in the vertical direction in the figure. The clamp 305 is pressed down and fit into a groove (not shown) formed in the periphery of the lamp cartridge 63 to prevent the lamp cartridge 63 from unexpectedly shifting in the direction B.

<Locking and Unlocking of Lamp Cartridge>

Next, explanation is made of locking and unlocking the lamp cartridge 63 with reference to FIG. 5, FIGS. 7A through 7D, FIG. 8, FIG. 9A and FIG. 9B.

Figure 8:
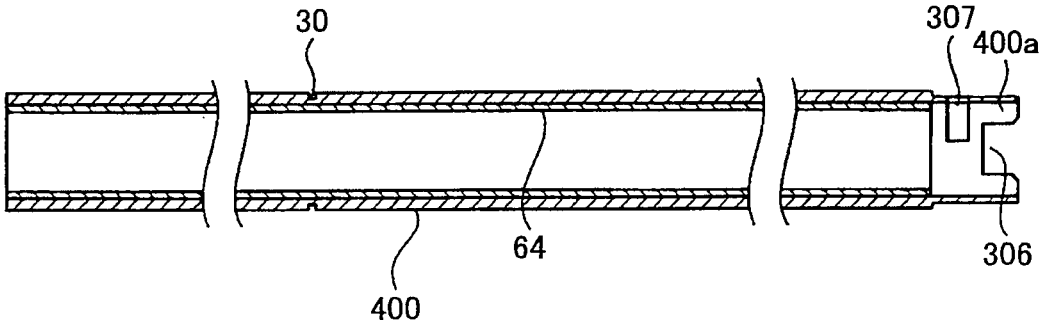
FIG. 8 is a cross-sectional view of the roller insert/pullout guide shaft and the lamp cartridge protection member structured in a single unit.

FIG. 8 is a cross-sectional view of the roller insert/pullout guide shaft 400, which is made of a metal or a heat resistant resin. The lamp cartridge protection member 64 made of a paper tube, a nonwoven material, rubber, or a soft synthetic resin is provided inside the roller insert/pullout guide shaft 400. In this embodiment, the roller insert/pullout guide shaft 400 and the lamp cartridge protection member 64 are formed into a single unit; however, they may de provided separately. When providing as separate components, the roller insert/pullout guide shaft 400 is inserted after the lamp cartridge protection member 64 is inserted in the guide shaft 400, or the roller insert/pullout guide shaft 400 may be inserted first and then the lamp cartridge protection member 64 is inserted in the guide shaft 400. Alternatively, only the roller insert/pullout guide shaft 400 may be used to replace the heating roller 14 and/or the lamp cartridge 63.

One or more cutouts 306 are formed in an end part 400*a* of the roller insert/pullout guide shaft 400, which are cut inward in the axial direction. The number of cutouts 306 is equal to the number of the interlock members 300. One or more long slits 307 extend in the circumferential direction of the roller insert/pullout guide shaft 400, which are positioned inward of the cutouts 306 in the axial direction. The number of the slits 307 is equal to the number of the interlock members 300. As illustrated in FIG. 8, a part of the cutout 306 and the slit 307 overlap each other in the circumferential direction of the roll insert/pullout guide shaft 400.

As illustrated in FIG. 5, the inner diameter of the lamp cartridge protection member 64 is substantially the same as the outer diameter of the second lamp holder 62. The length of the roller insert/pullout guide shaft 400 is slightly greater than the distance between the left-hand side and the right-hand side frames 50.

Figure 9A:
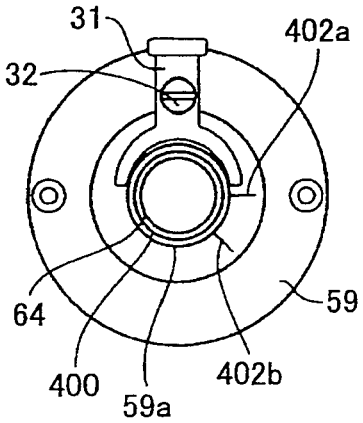
FIG. 9A and FIG. 9B illustrate the roller insert/pullout guide shaft inserted in the housing.
Figure 9B:
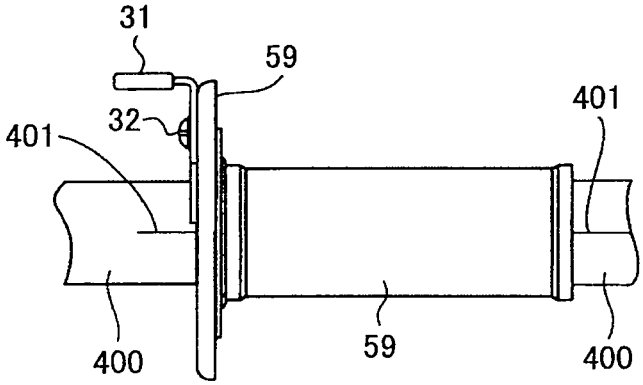

As illustrated in FIG. 9B, an alignment mark 401 extending as a straight line is formed on the outer surface of the roller insert/pullout guide shaft 400 in the axial direction. The alignment mark 401 extends from an end part 400*a* of the roller insert/pullout guide shaft 400 to the back end of the guide shaft 400. The alignment mark 401 can be checked from the outside of the housing 59 even if the roller insert/pullout guide shaft 400 is completely inserted into the image forming apparatus.

As illustrated in FIG. 9A, a through-hole 59*a* is formed in the end face of the housing 59. An insert position indication mark 402*a* for indicating the insert position of the roller insert/pullout guide shaft 400 and an interlock releasing position mark 402*b* indicating the interlock releasing position of the roller insert/pullout guide shaft 400 are formed in the end face of the housing 59 so as to extend from the through-hole 59*a* in the radial directions.

In this embodiment, the alignment mark 401, the insert position indication mark 402*a* and the interlock releasing position mark 402*b* are formed by grooving in the end face; however, these marks may be formed by other means, such as printing.

When the stopper 31 (FIG. 5) is elevated to insert the roller insert/pullout guide shaft 400 into the through-hole 59*a* of the housing 59 in the direction B (FIG. 5), the alignment mark 401 formed in the roller insert/pullout guide shaft 400 is aligned to the insert position indication mark 402*a* of the housing 59. Then, the roller insert/pullout guide shaft 400 is inserted keeping the alignment mark 401 in alignment with the insert position indication mark 402.

The roller insert/pullout guide shaft 400 is inserted smoothly, guided by the inner cylinder 59*b*, a tapered surface 62*a* (FIG. 5) of the second lamp holder 62, and the retaining member 48. Then, the end part (leading end) 400*a* of the roller insert/pullout guide shaft 400 is fit into the dent 61*b* formed in the first lamp holder 61 to receive the roller insert/pullout guide shaft 400, as illustrated in FIG. 7A. Since the insertion is carried out by keeping the alignment mark 401 in alignment with the insert position indication mark 402*a*, the positional relationship between the slit 307 formed in the roller insert/pullout guide shaft 400 and the hook 301 is correctly maintained.

When the roller insert/pullout guide shaft 400 is further inserted from the state of FIG. 7A, the leading end 400*a* slides under the base end 301*a* of the hook 301. Accordingly, the hook 301 rotates about the pin 302 and goes down toward the roller insert/pullout guide shaft 400 against the tension of the tension spring 303.

Figure 6:
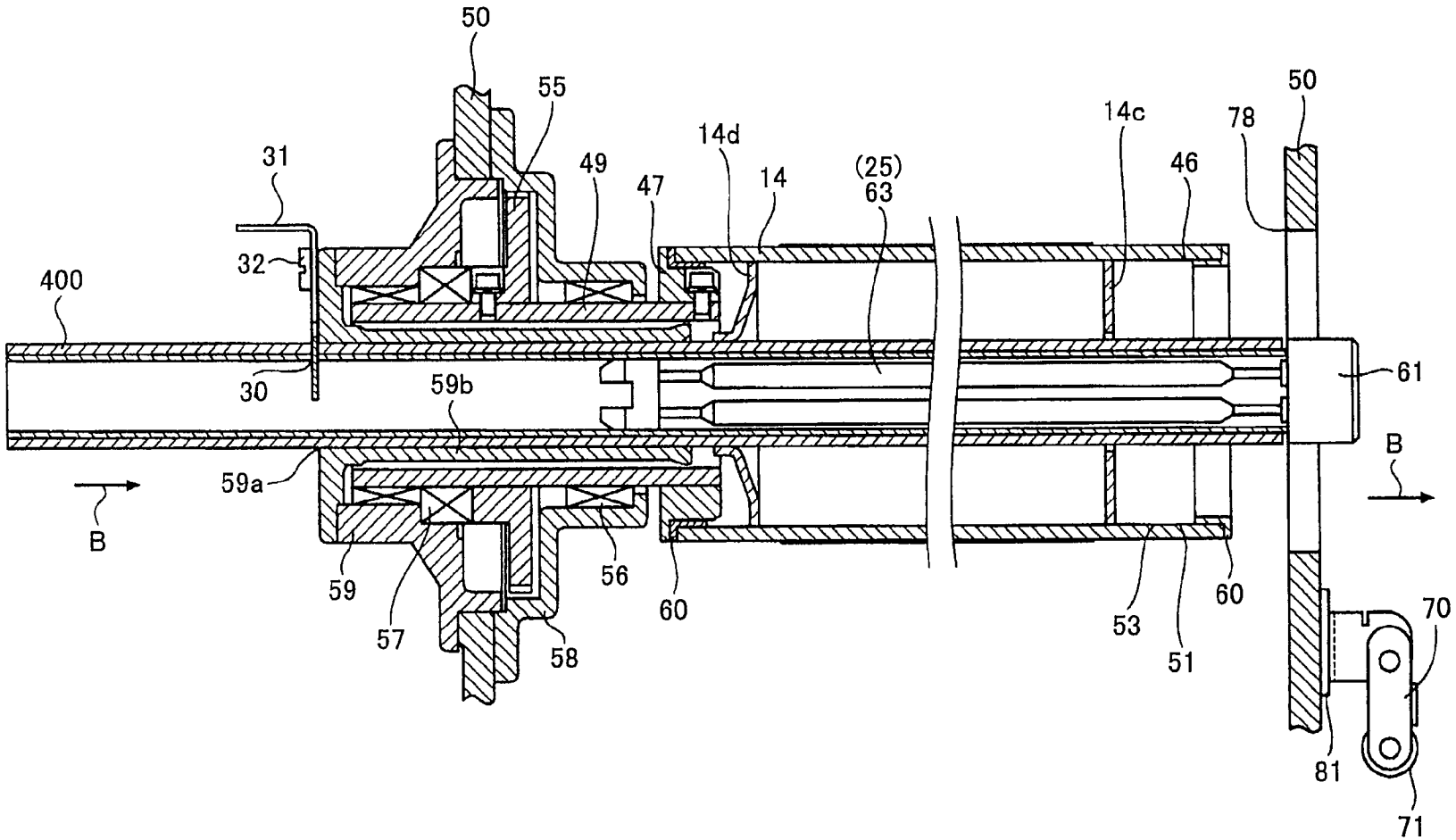
FIG. 6 is a cross-sectional view of the fixing device illustrating the state before the heating roller is removed.
Figure 7B:
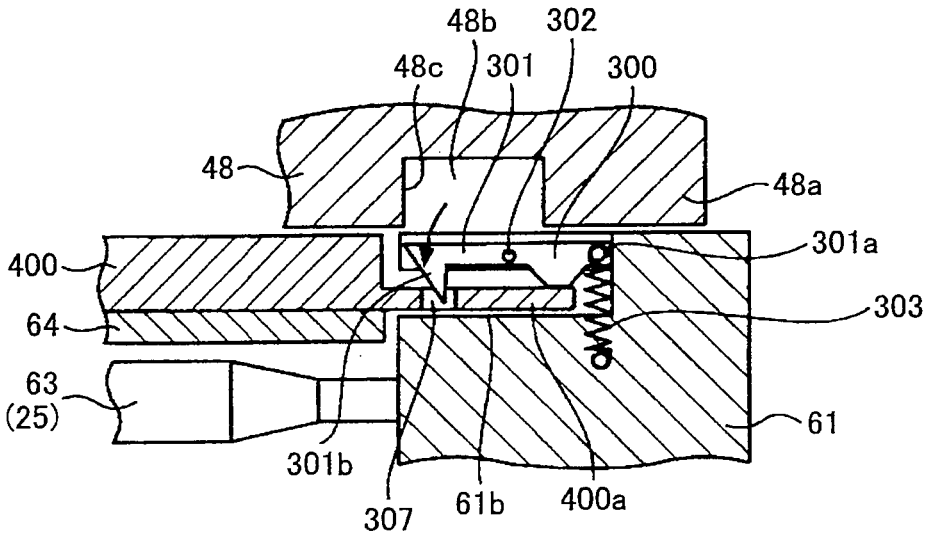

Due to the rotation of the hook 301, the claw 301*b* of the hook 301 is fit into the slit 307 of the roller insert/pullout guide shaft 400, as illustrated in FIG. 7B. The roller insert/pullout guide shaft 400 is interlocked with the lamp cartridge 63, and simultaneously, the lamp cartridge 63 is unlocked from the retaining member 48. Since the leading end 400*a* of the roller insert/pullout guide shaft 400 exists between the bottom face of the dent 61*b* (for receiving the roller insert/pullout guide shaft) of the first lamp holder 61 and the base end 301*a* of the hook 301, the state shown in FIG. 7B is maintained. When the roller insert/pullout guide shaft 400 has been inserted to the right position, the stopper 31 is pressed down into the receiving slot 30 of the guide shaft 400 to restrict the movement of the roller insert/pullout guide shaft 400 in the axial direction (as illustrated in FIG. 5 and FIG. 6).

In this manner, the interlock between the retaining member 48 and the lamp cartridge 63 is released, while the lamp cartridge 63 is interlocked via the interlock member 300 with the roller insert/pullout guide shaft 400, and the roller insert/pullout guide shaft 400 is fixed to the housing 59 (forming the body frame of the image forming apparatus) via the stopper 31. Accordingly, replacement of the heating roller 14 can be carried out, while leaving the lamp cartridge 63 in the image forming apparatus, using the replacement aid (the assisting unit 40, the bearing roller unit(s) 70, and the roller insert/pullout guide shaft 400). The pullout operation of the heating roller 14 is illustrated in FIG. 6 and FIG. 15.

When a new heating roller 14 is set in the image forming apparatus through the roller insert/pullout guide shaft 400 by replacement, the retaining member 48 is fit into the opening of one end of the heating roller 14 in the direction A (FIG. 5), and secured to the frame 50 using the wing screw 54.

Then, the roller insert/pullout guide shaft 400 is rotated in the clockwise direction in FIG. 9A to bring the alignment mark 401 (FIG. 9B) formed in the surface of the roller insert/pullout guide shaft 400 into alignment with the interlock releasing position mark 402*b* shown in FIG. 9A.

Figure 7C:
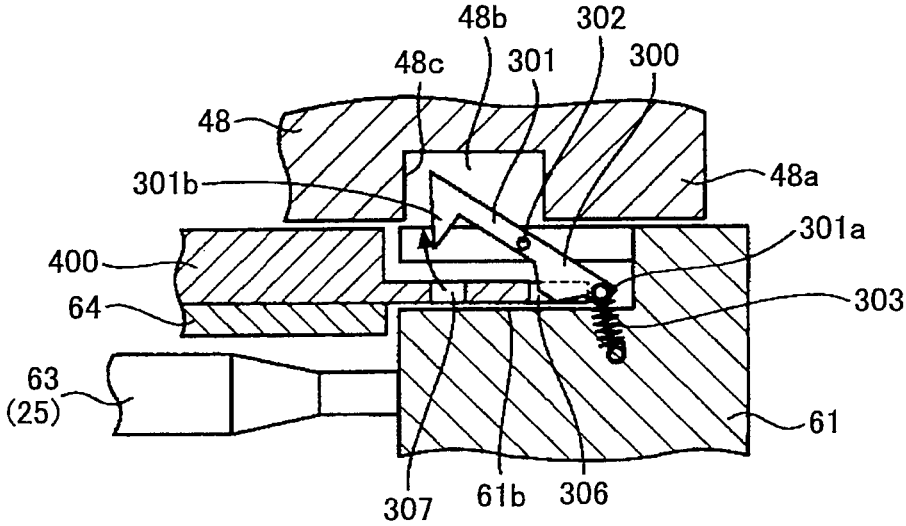
Figure 7D:
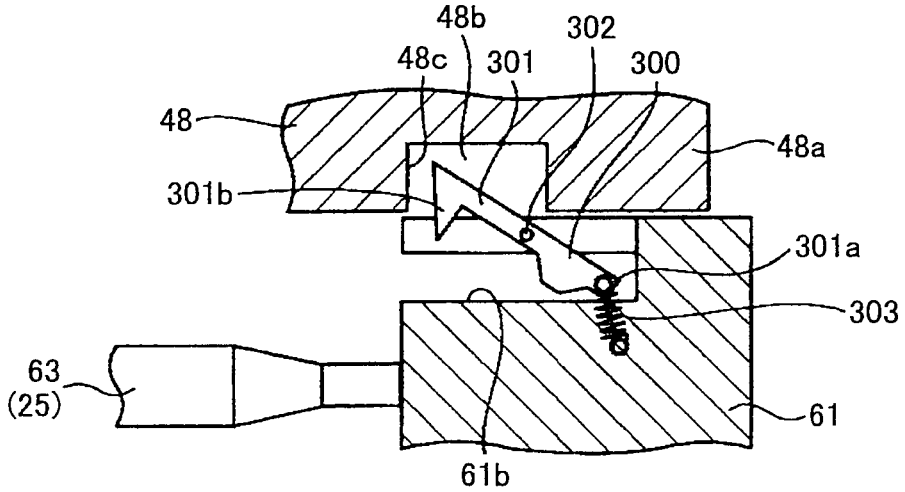

Along with the rotation of the roller insert/pullout guide shaft 400, the end part 400*a* of the roller insert/pullout guide shaft 400 located under the hook 301 (FIG. 7B) also rotates, and the cutout 306 (see FIG. 8) formed in the roller insert/pullout guide shaft 400 comes to the position under the hook 301. The base end 301*a* of the hook 301, which has been elevated by the end part 400*a* of the roller insert/pullout guide shaft 400, looses the support, and the base end 301*a* of the hook 301 falls into the cutout 306, as illustrated in FIG. 7C. Due to this, the hook 301 rotates upward as illustrated by the arrow due to the tension of the tension spring 303. As a result, the claw 301*b* of the hook 301 comes out of the slit 307, and the interlock between the lamp cartridge 63 and the roller insert/pullout shaft 400 is released. After the release, the roller insert/pullout guide shaft 400 is pulled out in the direction A, and the replacement of the heating roller 14 is finished. At this point of time, the claw 301*b* of the hook 301 has returned to the ordinary position and is fit into the recess 48*b* of the retaining member 48, as illustrated in FIG. 7D.

Although not shown in the figures, the connector provided at the end of the electric feed line extending from the lamp cartridge 63 has such an outer diameter that allows the connector to be accommodated in the roller insert/pullout shaft 400 (within the lamp cartridge protection member 64). During the replacement of the heating roller 14, the connector is accommodated together with the lamp cartridge 63 inside the roller inert/pullout guide shaft 100 (and the lamp cartridge protection member 64).

A certain degree of rigidity is given to the electric feed line so as to prevent disconnection due to bending inside the roller insert/pullout guide shaft 400 (and the lamp cartridge protection member 64). Although not shown in the figure, other connectors are provide directly to the first and the second lamp holders 61 and 62 so as not to disturb the electric wiring during the replacement of the heating roller 14, thereby improving the workability.

<Replacement Process of Heating Roller>

Next, explanation is made of the heating roller replacement process. The heating roller 14 is replaced when it comes to the end of the working lifetime or when it has to be changed to another type of heating roller 14 in order to satisfy a specific demand required for the image forming apparatus.

Figure 16:
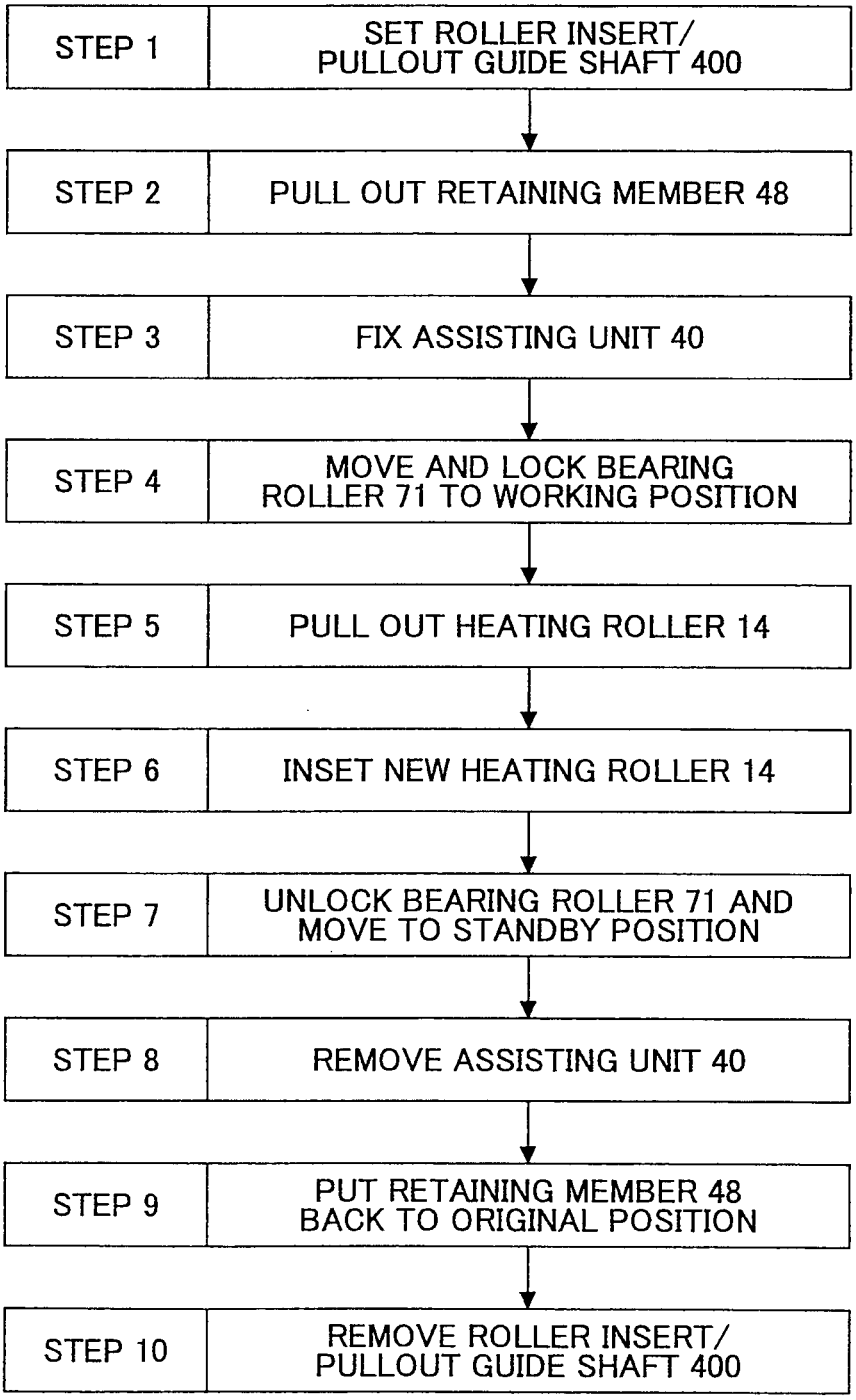
FIG. 16 is a flowchart showing the process of the replacement of the heating roller.

FIG. 16 is a flowchart showing the heating roller replacement process. First, in step 1, the roller insert/pullout guide shaft 400 is inserted into the through-hole 59*a* of the housing 59 in the direction B as illustrated in FIG. 5. The roller insert/pullout guide shaft 400 is guided by the inner cylinder 59*b* of the housing 59, one of the absorbers 14*d*, and retained by the retaining member 48. When the roller insert/pullout guide shaft 400 is inserted to a predetermined position, the stopper 31 is inserted into the receiving slot 30 of the roller insert/pullout guide shaft 400 (see FIG. 6). At this point of time, insertion of the roller insert/pullout guide shaft 400 is completed.

Since the lamp cartridge 63 is accommodated in the roller insert/pullout guide shaft 400, the lamp cartridge 63 is protected from unexpected or undesired damage or breakage during the replacement process.

To replace only the lamp cartridge 63, the stopper 31 is removed from the receiving slot 30 to pull out the lamp cartridge 53 from the roller insert/pullout guide shaft 400 in either direction A or B shown in FIG. 5 and FIG. 6. Thus, only the lamp cartridge 63 can be replaced without hindrance.

In step 2, the wing screw 54 is loosened to pull out the retaining member 48, which holds the centering member 46, the bearing 51, the spring 52 and the stopper plate 53, in the direction B. Since the end part of the roller insert/pullout guide shaft 400 slightly projects outward from the outer face of the frame 50, the retaining member 48 can be pulled out smoothly without hitting the opening of the frame 50 according to the guide using the roller insert/pullout guide shaft 400.

During the pullout operation, the centering member 46 is apart from the heating roller 14, and the centering member 46 and the bearing 51 are pressed against the stopper plate 53 due to the resilience of the spring 52. The bearing roller 71 of the bearing roller unit 70 is at the standby position (downward position), and it does not disturb the pullout operation of the retaining member 48.

In step 3, the handle 66 of the assisting unit 40 is held by hand and inserted into the roller insert/pullout guide shaft 400 from its leading end in which an inclination 30*b* (FIG. 5) is formed. At this point of time, the levers 41*c* of the latches 41 are open outward, as illustrated in FIG. 11A, and accordingly the distance L1 between the end wall 45*a* of the assisting unit main body 45 and the clipping piece 43*a* of the holder 43 is wide.

When the assisting unit 40 is inserted into the heating roller 14, the clipping piece 43*a* of the holder 43 passes through the cutout (not shown) of the absorber 14*c* and moves into the inside of the absorber 14*c*.

The assisting unit 40 is rotated in one direction with the handle 66 gripped. The rotation of the assisting unit 40 stops when the root of the clipping piece 43 comes into contact with the edge of the cutout (not shown) of the absorber 14*c*. Then, the levers 41*c* of the latches 41 are pivoted inward to as to close toward each other, and the clipping piece 43*a* of the holder 43 is pulled toward the assisting unit main body 45*a*, as illustrated in FIG. 11B. In this state, the inner periphery of the absorber 14*c* is held between the clipping piece 43*a* of the holder 43 and the end wall 45*a* of the assisting unit main body 45. Thus, the assisting unit 40 is fixed to the heating roller 14 via the absorber 14*c*.

In step 4, the bearing roller 71 is moved to the working position and locked thereto. The motion and the locking of the bearing roller 71 are carried out by rotating the roller plate 73 by 180 degrees in the direction opposite to the arrow F shown in FIG. 12C and bringing the hook 76 is fit into the groove 77. As a result, the bearing roller 71 is positioned facing the opening 78 of the frame 50 as illustrated in FIG. 15.

In step 5, the heating roller 14, which still remains at a high temperature, is pulled out of the image forming apparatus using the assisting unit 40 with the handle 66 gripped by a hand. The roller insert/pullout guide shaft 400 is securely held by the inner cylinder 59*b* of the housing 59, and the inner periphery of the absorber 14*d* slides over the outer surface of the roller insert/pullout guide shaft 400. A part of the heating roller 14 pulled out of the frame 50 is supported by the bearing rollers 71*a* and 71*b* in a stable manner. As the heating roller 14 is pulled out, the bearing rollers 71*a* and 71*b* rotate.

FIG. 14 illustrates how the heating roller 14 is supported. The heating roller 14 is supported by the bearing rollers 71*a* and 71*b* by point contact P at two positions. Under this structure, it is unnecessary to hold the high-temperature heating roller 14 at about 200° C. by hand, and the heating roller 14 can be pulled out in safe, avoiding troubles.

While the heating roller 14 is pulled out, the centering member 47 and the retaining member 49 remain as they are. FIG. 15 illustrates the heating roller 14 in the middle of the pullout operation. Each of the bearing rollers 71 is at the rising position and located closer to the frame 50 than the end of the first lamp holder 61 integrated in the roller insert/pullout guide shaft 400 is. Before the trailing end of the heating roller 14 has come out from the first lamp holder 61, the outer surface of the heating roller 14 is supported by the bearing rollers 71.

Then, in step 6, a new heating roller (not shown) is fixed to the assisting unit 40, and the new heating roller 14 is inserted into the image forming apparatus using the assisting unit 40 and the roller insert/pullout guide shaft 400. Again, the bearing rollers 71*a* and 71*b* are used to load the new heating roller 14. The new heating roller 14 is inserted smoothly to the prescribed position, while the inner periphery of the absorber 14*d* of the new heating roller 14 is sliding over the outer surface of the roll insert/pullout guide shaft 400.

In step 7, the bearing rollers 71*a* and 71*b* are unlocked, and they are moved back to the standby positions. Since the unlocking and returning to the standby position have been described above with reference to FIG. 12A through FIG. 12F, overlapping explanation is omitted.

In step 8, the assisting unit 40 is taken out of the heating roller 14, and the retaining member 48 is fixed in step 9.

In step 10, the stopper 31 is removed and the roller insert/pullout guide shaft 400 is rotated at a predetermined angle to release the connection with the interlock member 300 provided to the first lamp holder 61. Then, the roller insert/pullout guide shaft 400 is pulled out of the image forming apparatus and the replacement process for the heating roller 14 is finished.

The insertion of the new heating roller 14 in step 6 is the reverse procedure of the pullout of the old heating roller 14 in step 5, the removal of the assisting unit 40 in step 8 is the reverse procedure of the attachment of the assisting unit 40 in step 3, and the fixing of the retaining member 48 is the reverse procedure of the unfixing and removal of the retaining member 48 in step 2. Accordingly, detailed explanation for these steps is omitted. The removal of the roller insert/pullout guide shaft 400 in step 10 has already been explained with reference to FIG. 5, and the explanation for it is omitted here.

In this invention, a roller insert/pullout guide shaft is inserted within the heating roller when replacing the heating roller. The inner diameter of the roller insert/pullout guide shaft is substantially the same as the outer diameter of the second lamp holder, and the outer diameter of the roller insert/pullout guide shaft is substantially the same as the outer diameter of the first lamp holder. The first lamp holder has an interlock member, which is to be engaged with the roller insert/pullout guide shaft. A stopper is used to constrain the motion of the roller insert/pullout guide shaft in the axial direction. With these arrangements, the heating roller can be inserted in and pulled out of the image forming apparatus along the axial direction, without removing the lamp cartridge.

Multiple protection members are provided inside the roller insert/pullout guide shat along the entirety of the inner circumference or along the axis of the guide shaft to protect the hater lamps, by providing a paper cylinders or applying or bonding a nonwoven material. Accordingly, the protection and safety of the heater lamp can be improved.

Preferably, a metallic material is used for the outer face of the roller insert/pullout guide shaft that allows the heating roller to be moved in the axial direction during the replacement. This arrangement allows the roller insert/pullout guide shaft to serve satisfactorily as a guide.

A heating roller cover is provided in the vicinity and inward the opening of the heating roller to cover the opening. The heating roller cover has a through-hole at the center, through which the lamp cartridge and the roller insert/pullout guide shaft pass. The inner diameter of the through-hole is substantially the same as the outer diameter of the roll insert/pullout guide shaft. The through-hole of the heating roller cover serves as a bearing for holding the heating roller over the roller insert/pullout guide shaft, and the replacement of the heating roller can be facilitated, thereby eliminating the necessity for holding the heating roller by hand during the replacement.

The retaining member has a through-hole which functions as lamp cartridge retention means. The inner diameter of the through-hole of the retaining member is substantially the same as the outer diameters of the roller insert/pullout guide shaft and the first lamp holder. This arrangement allows the retaining member to be attachable and detachable.

By providing the retaining member with a coupling member for coupling the retaining member to the heating roller and a handle, the retaining member and the heating roller are formed in a single unit.

An assisting unit for assisting the pullout operation of the heating roller is coupled to the leading end in the pullout direction of the heating roller. The assisting unit has an assisting unit coupling unit for coupling the heating roller, and a handle is provided to the assisting unit main body. With this arrangement, the assisting unit can be coupled to the heating roller in an attachable and detachable manner.

This patent application claims the benefit of earlier application date of Japanese patent application No. 2010-015767 filed on Jan. 27, 2010, the entire contents of which are incorporated herein by reference.

The invention claimed is:

1. A fixing device comprising:

a heating roller;

a pressure roller configured to be pressed against the heating roller;

a lamp cartridge having a plurality of heater lamps arranged in the heating roller, a first lamp holder for holding first ends of the heater lamps, and a second lamp holder for holding other ends of the heater lamps;

a frame having an opening to allow replacement of the heating roller;

a retaining member for retaining the heating roller against the frame, while holding the lamp cartridge at the center of the heating roller, and configured to close the opening of the frame; and an interlock means that allows locking and unlocking between the first lamp holder and the retaining member, wherein the first lamp holder is placed in the inner periphery of the retaining member, and wherein when replacing the heating roller, the retaining member is unlocked from the first lamp holder, and the retaining member and the heating roller are pulled out from the opening of the frame, while leaving the lamp cartridge in the fixing device.

2. An image forming apparatus having a fixing device according to claim 1 for fixing an unfixed toner image onto a recording medium.

3. A fixing device comprising:

a heating roller having an axis corresponding to an axial direction;

a pressure roller configured to be pressed against the heating roller;

a lamp cartridge having a first lamp holder for holding first ends of multiple heater lamps serving as heat sources and a second lamp holder for holding other ends of the heater lamps inside the heating roller;

a retaining member for retaining the heating roller and the lamp cartridge against a frame, the retaining member having a lamp cartridge retention unit configured to retain the lamp cartridge at the center of the heating roller; and a fixing mechanism for heating and pressing a recording medium on which an unfixed toner image is formed, while nipping and transporting the recording medium between the heating roller and the pressure roller, to fix the toner image onto the recording medium, the heating roller being arranged so as to be replaceable in the axial direction, wherein an outer diameter of the second lamp holder is substantially the same as an inner diameter of a roller insert/pullout guide shaft which is inserted into the heating roller in an attachable and detachable manner when replacing the heating roller, wherein the outer diameter of the roller insert/pullout guide shaft is substantially the same as the outer diameter of the first lamp holder, wherein the first lamp holder has an interlock member configured to engage the first lamp holder with the roller insert/pullout guide shaft, and wherein the fixing device has a stopper configured to constrain the movement of the roller insert/pullout guide shaft in the axial direction.

4. The fixing device according to claim 3, wherein multiple protection members for protecting the heater lamps are provided inside the roller insert/pullout guide shaft along the entirety of an inner circumference of the roller insert/pullout guide shaft or along an axial direction of the roller insert/pullout guide shaft.

5. The fixing device according to claim 3, wherein the roller insert/pullout guide shaft is formed of a metallic material.

6. The fixing device according to claim 3, further comprising:

a heating roller cover arranged inside an opening of the heating roller near the end of the heating roller, wherein the heating roller cover has a through-hole at the center for allowing the roller insert/pullout guide shaft to pass through the heating roller cover, and the inner diameter of the through-hole is substantially the same as the outer diameter of the roller insert/pullout guide shaft.

7. The fixing device according to claim 3, wherein the retaining member has a through-hole that serves as a lamp cartridge retaining member, and the inner diameter of the lamp cartridge retaining member is substantially the same as the outer diameter of the roller insert/pullout guide shaft and the outer diameter of the first lamp holder.

8. The fixing device according to claim 3, further comprising:

a coupling member for coupling the retaining member to the heating roller; and a handle to structure the retaining member and the heating roller in a single unit.

9. The fixing device according to claim 3, wherein an assisting unit for assisting a pullout operation of the heating roller is coupled to a leading end of the heating roller along the pullout direction, and the assisting unit has a coupling unit for coupling the assisting unit with the heating roller and an attaching/detaching handle.

* * * * *